US005136821A

United States Patent [19]

Child

[11] Patent Number: 5,136,821

[45] Date of Patent: Aug. 11, 1992

[54] METHOD OF FORMING NOISE ATTENUATION BARRIER

[75] Inventor: Christopher L. Child, Cedarburg, Wis.

[73] Assignee: CECCO Trading, Inc., Milwaukee, Wis.

[21] Appl. No.: 604,806

[22] Filed: Oct. 29, 1990

[51] Int. Cl.[5] ..... E04B 1/82

[52] U.S. Cl. ..... 52/144; 52/169.4; 52/238.1; 52/742; 52/799; 181/290; 181/296

[58] Field of Search ..... 52/144, 145, 169.8, 52/169.9, 742, 292, 293, 799, 169.1, 169.2, 169.3, 169.4, 809, 238.1, 241; 181/290, 291, 292, 293, 296

[56] References Cited

U.S. PATENT DOCUMENTS

| | | | |
|---|---|---|---|
| 3,611,653 | 4/1970 | Zinn | 181/290 |
| 3,630,310 | 12/1971 | Federer | 181/33 G |
| 4,084,367 | 4/1978 | Saylor et al. | 52/809 X |
| 4,160,491 | 7/1979 | Matsumoto et al. | 181/294 X |
| 4,238,913 | 12/1980 | Holmes | 52/238.1 |
| 4,425,980 | 1/1984 | Miles | 181/290 X |
| 4,437,542 | 3/1984 | Yeager et al. | 52/144 X |
| 4,605,090 | 8/1986 | Melfi | 181/210 |
| 4,838,524 | 6/1989 | McKeown et al. | 52/145 X |
| 4,964,250 | 10/1990 | Nelson | 52/809 X |
| 5,056,279 | 10/1991 | Veldheon | 52/144 |

FOREIGN PATENT DOCUMENTS

| | | | |
|---|---|---|---|
| 0039984 | 11/1981 | European Pat. Off. | 181/210 |
| 0381000 | 1/1990 | European Pat. Off. | 52/809 |
| 2343617 | 8/1973 | Fed. Rep. of Germany . | |
| 3043876 | 9/1982 | Fed. Rep. of Germany | 181/210 |
| 3300024 | 7/1984 | Fed. Rep. of Germany | 256/73 |

*Primary Examiner*—David A. Scherbel
*Assistant Examiner*—Kien Nguyen
*Attorney, Agent, or Firm*—Whyte & Hirschboeck

[57] ABSTRACT

A noise attenuation barrier for control of noise along expressway or other noise sources is provided in which the panel sections are suspended on vertical posts installed in earth berms. The bottoms of the panels, which are shaped to match the contour of the berm are partly buried in a particulate, sound-absorbing layer. The panels include an imperforate rear wall, spaced away from which is a sound-absorbing layer held in place by edge strips that are fit over the tops and bottoms of the layer before it is put in place.

5 Claims, 2 Drawing Sheets

Figure 3:
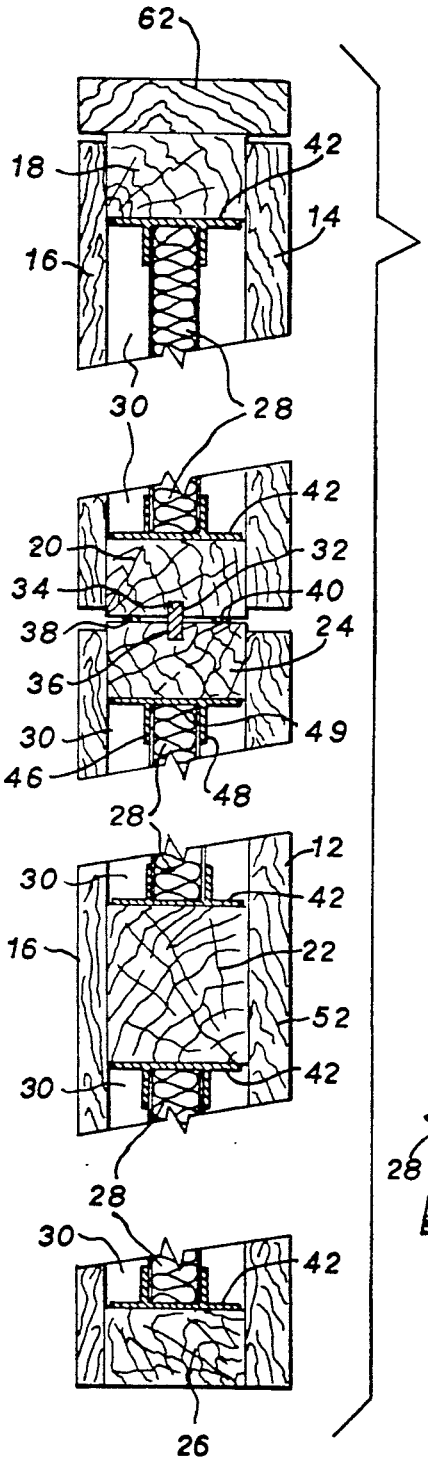

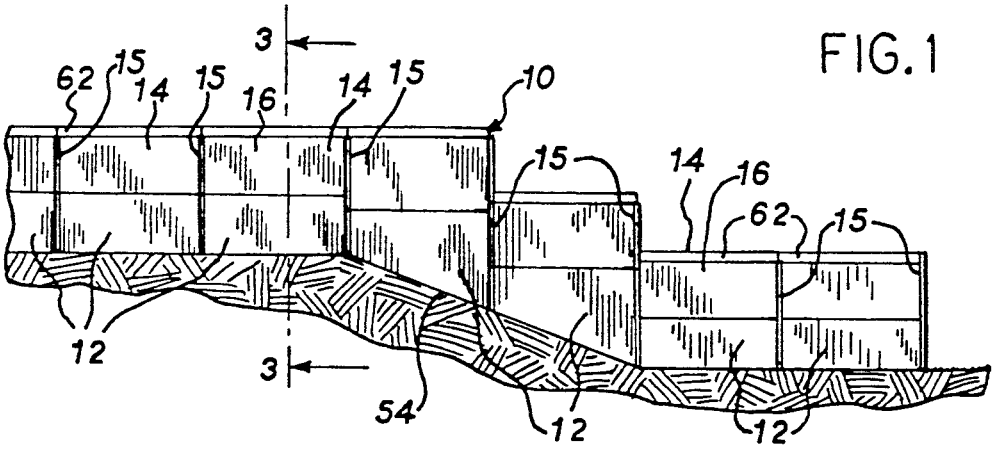
FIG. 1
FIG. 2
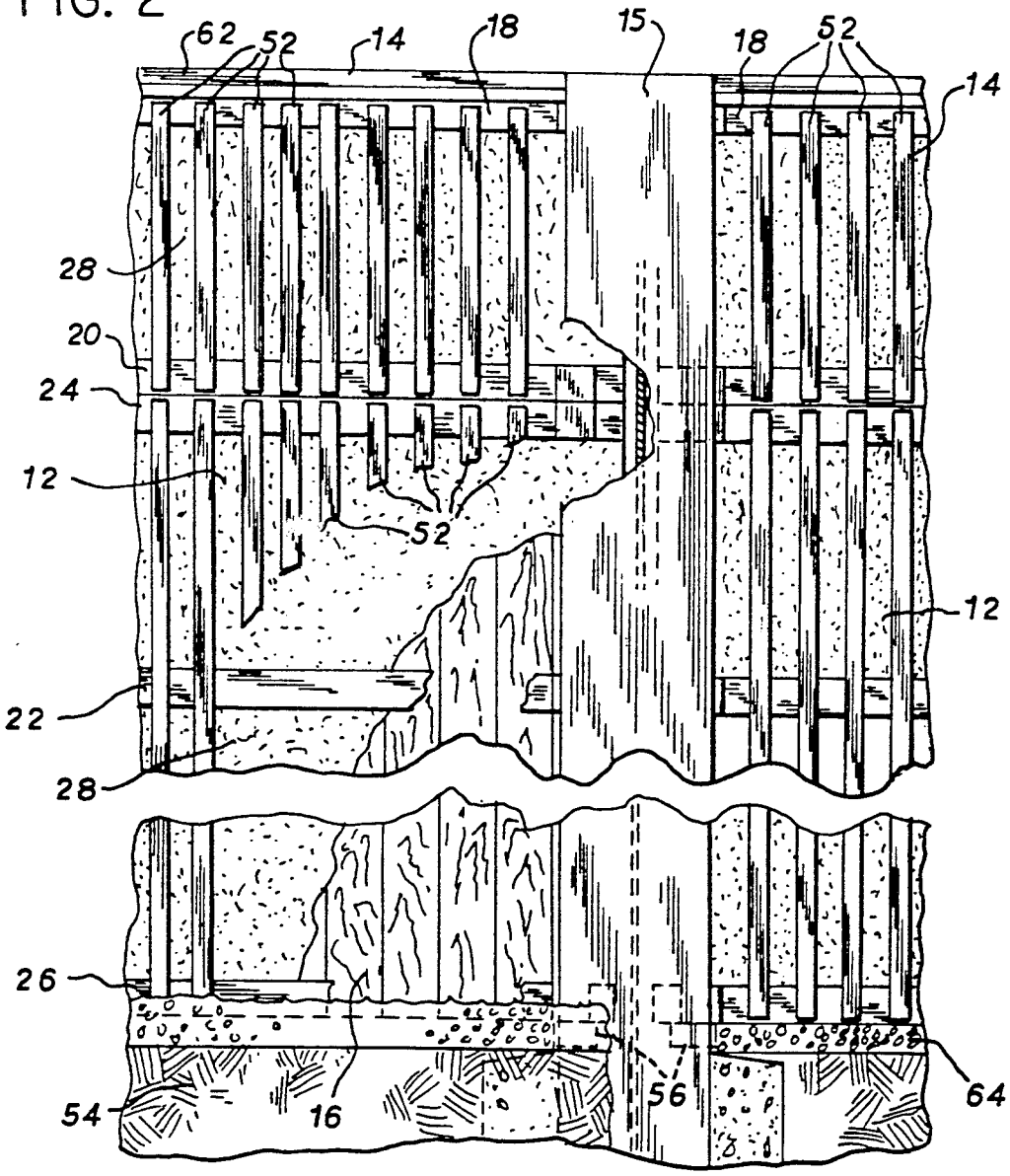

METHOD OF FORMING NOISE ATTENUATION BARRIER

BACKGROUND OF THE INVENTION

This invention relates to an improved noise barrier construction and method of making and installing the same.

Various noise barrier systems have been devised to control noise pollution emanating from express highways, railroad tracks or factories. Many such systems include combinations of noise insulating materials, air space, and noise reflective plates. Examples of such systems which have heretofore proposed are shown, for example, in European Patent Application No. 039984 published Nov. 18, 1981, West German Patent Application No. DE3043876 published Sept. 9, 1982, West German Patent Application No. DE3300024 published July 5, 1984, West German Patent Application No. 2343617 published Aug. 27, 1973, U.S. Pat. No. 4,605,090 issued Aug. 12, 1986, and U.S. Pat. No. 3,630,310 issued Dec. 28, 1971.

In some of the prior art systems, the barrier panels are suspended above the earth. Such constructions permit noise to pass under the barrier. Another common construction involves the pouring of horizontal concrete bases to support the wall panels. The concrete surfaces, however, have been found to reflect most of the noise to the opposite side of the highway or other noise source. The use of such poured concrete bases is, moreover, costly and the resultant walls in hilly terrain have a stepped appearance with substantial sound reflective wall or step areas of concrete in addition to the barrier panels which are mounted above such footings.

Some systems such as those shown in U.S. Pat. No. 4,605,090 and German Application No. 3043876 have proposed the formation of concrete bases and panels that would be shaped to follow the contour of the earth. Such constructions, however, have been found to have shortcomings in terms of difficulty of manufacture and installation. Additionally, with many proposed prior art designs there is difficulty in obtaining adequate resistance to wind stresses encountered by such structures. A need has therefore continued to exist for improved sound barrier systems which are easy to assemble in commercial quantities and simple to install. It is the primary object of the present invention to fulfill this need. Other objects of the invention include providing a sound barrier system with increased sound absorbing characteristics and to provide such a system which can be easily assembled with a minimum of labor expense. A significant aspect of the invention relates to the elimination of the need for a concrete base for the sound barrier, the use of such bases having become standard in the industry. Further, objects and advantages will be apparent from the accompanying descriptions of the invention and drawings.

SUMMARY OF THE INVENTION

Briefly summarized, the invention includes the provision of a plurality of sound absorbing panels which include an imperforate sound reflecting rear wall, a perforated wall which faces the noise source and a sound absorbing layer contained within each panel and spaced away from the rear wall so as to create an air pocket between the sound insulating layer and the rear wall. A sound dissipating layer between the earth and the bottom edges of the panels both minimizes sound reflection and prevents significant travel of sound under the barrier.

In the preferred embodiment of the invention, the panels are secured to vertical posts placed in the earth and the sound absorbing panels are secured to such vertical posts. Optionally an earth berm can be formed along the installation site, and the posts are installed in the berm. The space between the bottom of the panels and the top of the earth is then filled with a sound dissipating weather resistant particulate-type material such as gravel, crushed rock or the like. The bottom panel in each section is formed of either a rectangular or a trapezoidal shape with horizontal top, vertical sides and a bottom edge angled to match the contour of the terrain at which the panel is installed. The bottom edge of the bottom panel is provided with a surface designed to match the slope of the earth. If the underlying ground is level or has an insignificant slope, the bottom panel is formed of a rectangular shape.

The sound insulating barrier of the present invention is prepared from individual panel compartments containing a noise absorbing layer cut to dimensions corresponding to those of the imperforate panel which forms the rear of each individual panel section. Attached to the imperforate rear panel are top and bottom edge beams forming an enclosure within which the sound absorbing layer is contained. The sound absorbing layer of the present invention is retained in place by either wood strips or by novel retainer strips which have flat bottom edges adapted to engage the edge beams. The spacer strip, which are preferably formed of recycled plastic, have a width approximately equal to the depth of the chamber so that the sound insulating layer is retained thereby without the necessity of securing the strips to the edge beams. The strips further have a pair of projecting side walls perpendicular to the base thereof which are spaced apart at distance equal to the thickness of the sound insulating layer and which thereby can retain said layer in place. A perforated front wall adapted to face the noise source forms the front wall of each panel section.

Each panel section can thus easily be assembled by laying the rear panel which has the top and bottom edge beams in place thereon in a horizontal orientation, placing the retainer strips on the top and bottom edges of the sound insulating layer and then dropping said layer in place over the rear panel. The perforated front wall can then be installed to complete the enclosure by securing the edges thereof to the edge panels. A plurality of panels thus formed is then installed in place in the noise source by installing vertical supporting poles in the earth at intervals such that the spaces between the posts equal the length of the panel sections The panels are secured to the posts by means of suitable attaching means such as pins, bolts, staples, clamps, wedges, clips, or the like. The panels may also be held in position by brackets attached to the posts and positioned under the bottom edges of the panels.

DRAWINGS

Figure 4:
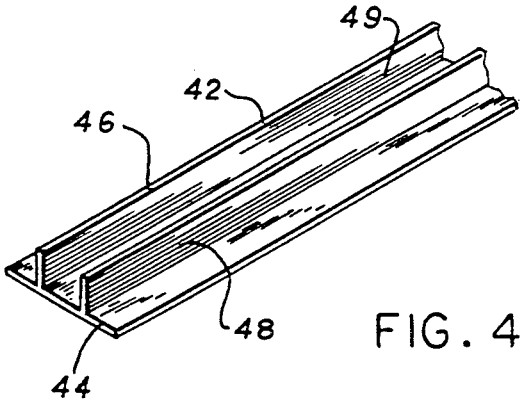
Figure 5:
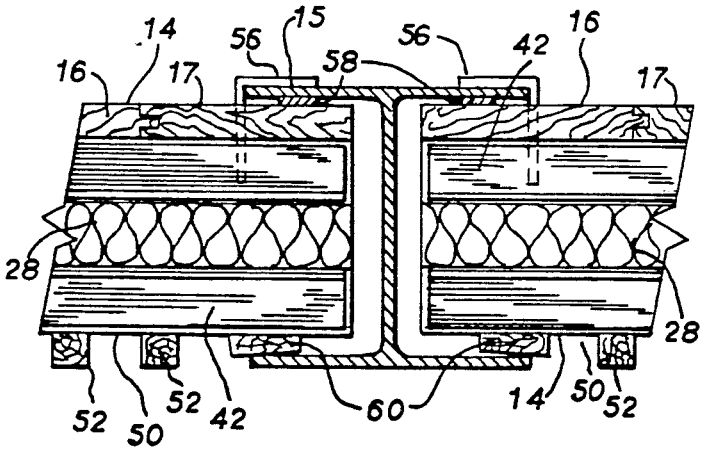

The invention will be further explained with reference to the accompanying drawings wherein:

FIG. 1 is a front view of a wall formed in accordance with the invention positioned on irregular terrain, FIG. 2 is a front elevational of a section of a barrier of the present invention with parts broken away, FIG. 3 is a cross-sectional taken along line 3—3 of FIG. 1 with parts shown in truncated form, FIG. 4 is a perspective view of a retaining strip used in the invention with an end broker away, and FIG. 5 is a top cross-sectional view showing the method of attachment of individual panels to a supporting post.

Referring more specifically to the drawings, a wall 10 is formed from a plurality of individual lower and upper segments 12 and 14 supported on posts 15.

In the embodiment of the invention shown in the drawings panel segments having lower panel sections 12 and upper sections 14 are shown. If desired, more than two such sections may be provided. The segments are connected to vertical posts 15 which may be formed from wood, metal or other materials. The spacing between posts is such that the spaces between the posts equals the length of the panel segments.

Each panel section 12 or 14 includes a rear wall 16 which is imperforate. While wood is preferred for reasons of economy, durability and workability other construction materials can be substituted for various parts of the barrier panels. Wall 16 can be formed of various materials, with tongue and groove wood plank 17 being shown for purposes of illustration. Top and bottom edge elements or beams 18 and 20 are affixed to the imperforate rear panel 16 as best seen in FIG. 3. Lower section 12, as illustrated, has a central cross member or beam 22 in addition to top edge member 24 and bottom edge member 26. The top section 14 optionally can be provided with a cross member, such as 22, in order to provide top sections of greater height. Sound absorbing layers 28 of materials such as a rock wool are suspended away from and parallel to the plane of the imperforated rear wall 16 as seen in FIGS. 3 and 5.

Sound absorbing layers 28 are preferably equal in length to the length of the segments between posts 15. Shorter pieces of such layers can be used, if desired, however. In order to provide sufficient long term stability and integrity to these layers, it is preferred that the height thereof be limited to one-half meter to one meter in the case of rock wool. In the event other insulation material is employed, the dimensions would be selected to suit the strength and integrity thereof. It will be apparent to those skilled in the art, that in addition to a rock wool, other materials could be substituted for the sound absorbing layer, for example, fiberglass, ceramic fibers, vermiculite layers, or composite materials which have appropriate sound absorbing characteristics as well as weather resistant qualities. Generally, the sound absorbing layers are approximately 2 to 5 centimeters in thickness. It has been found that the enclosed air spaces 30 have been found to significantly increase the sound absorbing capacity of the system. Depending on the nature of the material in the sound absorbing layer 28 the surfaces thereof may be coated in order to improve the weather resistance or sound absorption qualities of the material.

As seen in FIG. 3 the upper sections 14 can be joined to lower sections 12 by means of a continuous spline 32 which fits into grooves 34 and 36 in the upper and lower edge panels, respectively. Also, to reduce the possibilities of sound transmission through the joints between panel sections it is preferred that continuous elastic seals 38 and 40 may be employed. Such seals can either be formed of continuous strips of elastomeric material, or alternatively, conventional caulking materials may be employed.

Located at the top and bottom edges of the sound absorbing layers 28 in one embodiment of the invention are spacer strips 42 which include a base strip 44 to which are integrally attached perpendicular strips 46 and 48. Strips 46 and 48 between them form a channel 49 adapted to contain the edge of the sound insulating material 28. The surface of the sound absorbing barriers which faces the noise source is formed with openings 50 which are preferably formed by spaced apart strips 52 attached to the fronts of beams 18, 20, 22, 24, and 26.

Hithertofore it was necessary, due to available methods of construction, to slide the edges of a sound absorbing barrier into a groove or channel which could be cut, for example, into the surfaces of edges 18 and 20. In contrast, the panel sections of the present invention can be readily constructed by laying the section, for example an upper section 14, in a horizontal position with edge beams 18 and 20 in place. Channels 49 are then placed over the top and bottom edges of sound absorbing layer 28 and the assembly thus formed is dropped or placed into the opening between the edges 18 and 20. Strips 52 are then installed to form an enclosure. It is thus seen that the sound absorbing layer is held in place by the retaining strips 42 without the necessity of mechanical attachment.

The use of spacer strips 42 also greatly simplifies the task of removal of the sound absorbing layer from a panel should that ever become necessary after removal of a panel section from a barrier wall, the presence of the strips facilitates sliding of the absorbing layer out from a side of the section by reducing sliding friction between the sound absorbing layer and the edge berms of the panel section.

While the use of strips 42 has been shown for purposes of illustration, it is equally possible to secure the sound absorbing layer in place by means of wood strips placed on each side of the layer and secured to the top and bottom edge beams. A further alternative is the use of a notched or grooved wood retainer strip on the top side of the sound absorbing layer 28 and individual strips at the front and back of the bottom edge of the sound absorbing layer to facilitate assembly of the panel sections and to hold the layer in place after assembly.

The individual panel sections are thus formed with the uppermost sections being rectangular in configuration while the bottom sections may be formed of either a rectangular or a trapezoidal shape, as seen in FIG. 1, if needed to match the contour of the terrain.

Posts 15 are vertically erected on the structure, earth or on a berm 54 formed along the location at which the barrier is to be placed. The panel sections are then attached to the posts so that the bottoms thereof are spaced somewhat above the berm or earth 54. If wood posts are used, it is generally preferred to pin or bolt the panel segments to the posts.

In the embodiment shown in the drawings, posts of "H" shaped cross-section are employed. The sections can be held in place on the "H" shaped sections by means of metal clips 56, which may be formed of angle iron. It is also desirable to use elastic seals 58 between the panel surfaces and the posts in order to minimize sound transmission. The other side of the panels may be provided with wedge strips 60 to force the panels tightly against the seals 58 and to provide an effective sound barrier strip. The use of such seals assist in sealing off the dead air spaces 30 and prevents sound from traveling around the ends of the sound absorbing barriers 28. It is desirable to place a cap strip 62 over the tops of the panels to improve the appearance and weather tightness of the sound barrier.

Once the panel sections are thus installed, it is desirable to place a layer of particulate material such as gravel, aggregate, crushed volcanic rock, vermiculite, etc. over the earth 54 to a depth such that the bottom edges 26 of the panel sections are at least partly immersed in this barrier layer. This insures against sound transmission under the panel sections and provides an excellent sound-absorbing layer with minimal sound reflecting qualities.

In many locations, for example, where the height of the sound barrier structure requires, for example, due to water drainage patterns, the construction of an earthen berm is desirable. In other locations, the construction of a berm is not necessary. In addition, it will be apparent that the posts and related barrier structure of the present invention can also be attached to fixed structures, for example, retaining walls, bridges or buildings.

While I have described the preferred embodiments of the invention, the scope of the invention should not be limited thereby but rather should be deemed to be commensurate with the scope of the following claims.

What is claimed is:

1. A method of forming a sound absorbing acoustical barrier disposed on a terrain comprising (a) forming a plurality of panel sections including a plurality of bottom panels having generally vertical sides, horizontal tops and angled bottom edges, said bottom edges being angled to a degree corresponding to the slope of the terrain at which said panel sections are to be installed, and a plurality of rectangularly shaped upper panels, each of said bottom and upper panels formed by, (1) providing an imperforate rear wall, and attaching a perforated front wall spaced forwardly of said rear wall, attaching top and bottom edge beams to the top and bottom edges of said rear walls disposed between said front and rear walls, (2) providing a sound insulating layer having dimensions corresponding to those of the rear panel removed wall, (3) placing spacer strips over the top, and bottom edges of said sound insulating layer, each of said spacer strips having a flat base of a width to fit closely between said front and rear walls, and a pair of projecting sidewalls perpendicular to said base which are spaced apart a distance equal to the thickness of said sound insulating layer, (4) placing said sound insulating layer with said strips in place thereon on said rear wall with said strips engaging the interior sides of said edge beams, (b) installing vertical supporting posts at intervals in which the spaces between supporting posts equal the length of said front and rear walls on an earth berm at an installation location, (c) attaching the vertical sides of a plurality of said panel sections to said vertical posts with the bottoms of the bottom panels spaced above the earth berm and with said front wall facing a source of sound to be abated, and (d) filling the space between the bottom of the bottom panels and the earth berm with weather resistant particulate type material.

2. A method according to claim 1, wherein said sound-absorbing layer comprises rock wool.

3. A method according to claim 1, wherein said vertical posts are steel posts of an "H" shaped cross section, and said panel sections are held in place in the channels formed by said "H" shaped posts by supporting clips attached to said posts.

4. A method according to claim 1, said vertical posts are formed of wood.

5. A method according to claim 1, wherein the edge beams, and the front and rear panels are formed of wood.

* * * * *